US008074612B2

(12) United States Patent
Shin et al.

(10) Patent No.: US 8,074,612 B2
(45) Date of Patent: Dec. 13, 2011

(54) VARIABLE COMPRESSION RATIO APPARATUS

(75) Inventors: Min Sig Shin, Suwon (KR); Myung Rae Cho, Incheon (KR); Hong Wook Lee, Yongin (KR); Woo Tae Kim, Suwon (KR); Won Gyu Kim, Seoul (KR); Jin Woo Cho, Seongnam (KR)

(73) Assignee: Hyundai Motor Company, Seoul (KR)

( * ) Notice: Subject to any disclaimer, the term of this patent is extended or adjusted under 35 U.S.C. 154(b) by 520 days.

(21) Appl. No.: 12/323,918

(22) Filed: Nov. 26, 2008

(65) Prior Publication Data

US 2009/0241910 A1 Oct. 1, 2009

(30) Foreign Application Priority Data

Mar. 31, 2008 (KR) ..... 10-2008-0029944

(51) Int. Cl.
*F02B 75/04* (2006.01)

(52) U.S. Cl. ..... 123/48 B; 123/78 E

(58) Field of Classification Search ..... 123/48 B, 123/78 E, 78 F
See application file for complete search history.

(56) References Cited

FOREIGN PATENT DOCUMENTS

| | | |
|---|---|---|
| JP | 06-074059 | 3/1994 |
| JP | 2002-227674 | 8/2002 |
| JP | 2007-239555 A | 9/2007 |

*Primary Examiner* — Noah Kamen
(74) *Attorney, Agent, or Firm* — Morgan, Lewis & Bockius LLP

(57) ABSTRACT

A variable compression ratio apparatus is disclosed. An upper connecting rod has one end rotatably connected to a piston so as to reciprocate motion of the piston. A lower connecting rod has one end rotatably connected to the other end of the upper connecting rod. A crankshaft is rotatably mounted at an eccentric position of the lower connecting rod. A control rod has one end rotatably connected to the other end of the lower connecting rod, to control the position of that end of the lower connecting rod. A control shaft is connected to the other end of the control rod, to control the position of that end of the control rod.

14 Claims, 6 Drawing Sheets

VARIABLE COMPRESSION RATIO APPARATUS

CROSS-REFERENCE TO RELATED APPLICATION

This application claims priority to Korean Patent Application No. 10-2008-0029944 filed Mar. 31, 2008, the entire contents of which application is incorporated herein for all purposes by this reference.

BACKGROUND OF THE INVENTION

1. Field of the Invention

The present invention relates to a variable compression ratio apparatus. More particularly, the present invention relates to a variable compression ratio apparatus that changes the compression ratio of an air-fuel mixture in a combustion chamber according to a driving state of an engine.

2. Description of Related Art

Generally, thermal efficiency of combustion engines increases as a compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be advanced a lot and accordingly engine output may deteriorate.

A variable compression ratio (VCR) apparatus changes the compression ratio of an air-fuel mixture according to a driving state of an engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

A conventional variable compression ratio apparatus can achieve a predetermined compression ratio of the air-fuel mixture according to a driving state of the engine, but it cannot achieve different strokes corresponding to intake/compression/expansion/exhaust strokes, respectively. Particularly, if the stroke of the expansion stroke is longer than that of the compression stroke, thermal efficiency may further improve. However, it is difficult to achieve a longer expansion stroke than compression stroke according to the conventional variable compression ratio apparatus.

In addition, a high compression ratio/low exhaust amount at a low load condition and a low compression ratio/high exhaust amount at a high load condition may be preferable in order to achieve low fuel consumption and high power output.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention may provide for a variable compression ratio apparatus having advantages of enhancing fuel mileage and output as a consequence of changing compression ratio of air-fuel mixture according to driving conditions of an engine.

Various aspects of the present invention may provide for a variable compression ratio apparatus having advantages of further enhancing fuel mileage by achieving different strokes corresponding to intake/compression/expansion/exhaust strokes, respectively.

A variable compression ratio apparatus according to various embodiments of the present invention may be incorporated into an engine receiving a combustion force of an air-fuel mixture from a piston so as to drive a vehicle, and may change compression ratio of the air-fuel mixture.

One aspect of the present invention is directed to a variable compression ratio apparatus for an engine receiving a combustion force of an air-fuel mixture within a piston chamber so as to drive a vehicle, wherein the apparatus is configured to change compression ratio of the air-fuel mixture within the piston chamber. The apparatus may include an upper connecting rod having one end rotatably connected to the piston so as to receive combustion force of the air-fuel mixture, a lower connecting rod having one end rotatably connected to a second end of the upper connecting rod and rotated by the combustion force of the air-fuel mixture received from the upper connecting rod, a crankshaft eccentrically mounted to the lower connecting rod so as to be rotated thereby, a control rod provided with one end rotatably connected to a second end of the lower connecting rod so as to change the path of motion of the lower connecting rod, and/or a control shaft eccentrically and rotatably connected to a second end of the control rod and changing a position of the other end of the control rod.

The variable compression ratio apparatus may further include a planetary gear set that receives torque from a driving unit and changes phase angles of the crankshaft and the control shaft. The planetary gear set may include a first operating member connected to the control shaft and rotating with the control rod, second operating member connected to the crankshaft and rotating the crankshaft, and/or a third operating member connected to the driving unit and receiving the torque for changing the phase angle of the control shaft. A crank gear may be fixedly mounted at the crankshaft, and a control gear engaged with the crank gear may fixedly mounted at the second operating member.

The driving unit may include a drive shaft. A power delivery unit for being connected to and transmitting the torque to the third operating member may be mounted at the drive shaft. The driving unit may be configured such that a ratio of rotation speed of the crankshaft to that of the control shaft is approximately 1:1 or 1:2. The planetary gear set may have a sun gear, a ring gear, and a planet carrier. The first operating member may be the planet carrier, the second operating member may be the ring gear, and the third operating member may be the sun gear.

The lower connecting rod may have a fan shape, and both ends of the lower connecting rod are disposed on both ends of a fan-shaped arc.

Another aspect of the present invention is directed to a variable compression ratio apparatus including an upper connecting rod including a first and a second end, the first end being rotatably connected to a piston so as to reciprocate the piston, a lower connecting rod including a first and a second end, the first end being rotatably connected to the second end of the upper connecting rod, a crankshaft rotatably mounted at an eccentric position of the lower connecting rod, a control rod including a first and a second end, the first end being rotatably connected to the second end of the lower connecting rod so as to control a position of the second end of the lower connecting rod, and/or a control shaft connected to the second end of the control rod so as to control a position of the second end of the control rod.

A planetary gear set may be configured to control phase angles of the crankshaft and the control shaft. The planetary gear set may include a first operating member connected to the control shaft for rotating with the control rod, a second operating member connected to the crankshaft for rotating the crankshaft, and/or a third operating member connected to the driving unit for controlling the phase angle of the control shaft.

The variable compression ratio apparatus may further include a crank gear mounted to the crankshaft, and a control gear mounted to the second operating member and engaged with the crank gear. The driving unit may include a drive shaft, and the apparatus may further include a power delivery unit mounted at the drive shaft for operating the third operating member. The driving unit may be configured such that a ratio of a rotation speed of the crankshaft to a rotation speed of the control shaft is approximately 1:1 or 1:2. The first operating member may be a planet carrier, the second operating member may be a ring gear, and the third operating member may be a sun gear. The lower connecting rod includes an oblong shape.

An engine may including a piston cylinder and any of the above-described variable compression ratio apparatuses.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
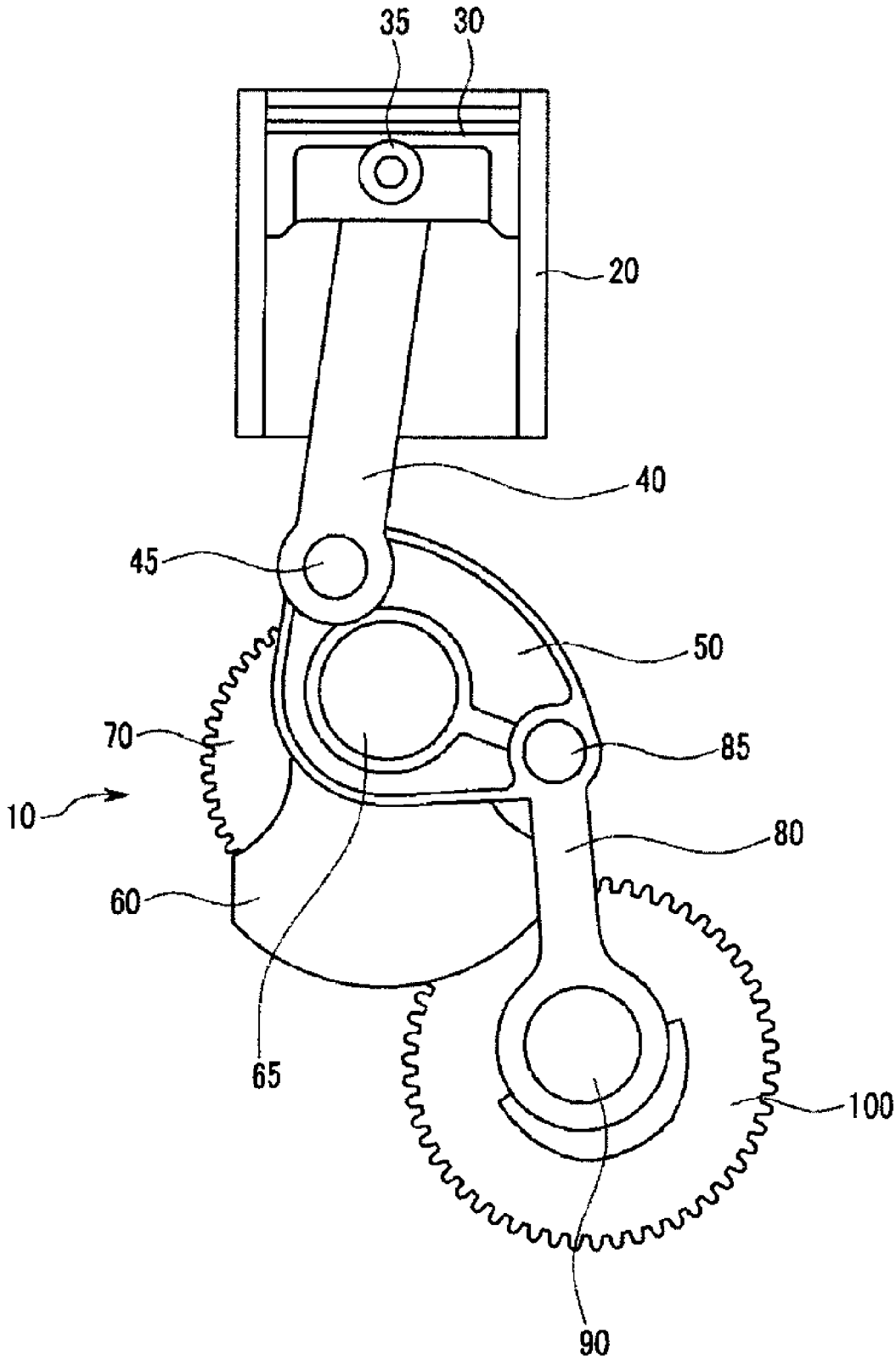
FIG. 1 is a schematic diagram of an exemplary variable compression ratio apparatus according to the present invention.
Figure 2:
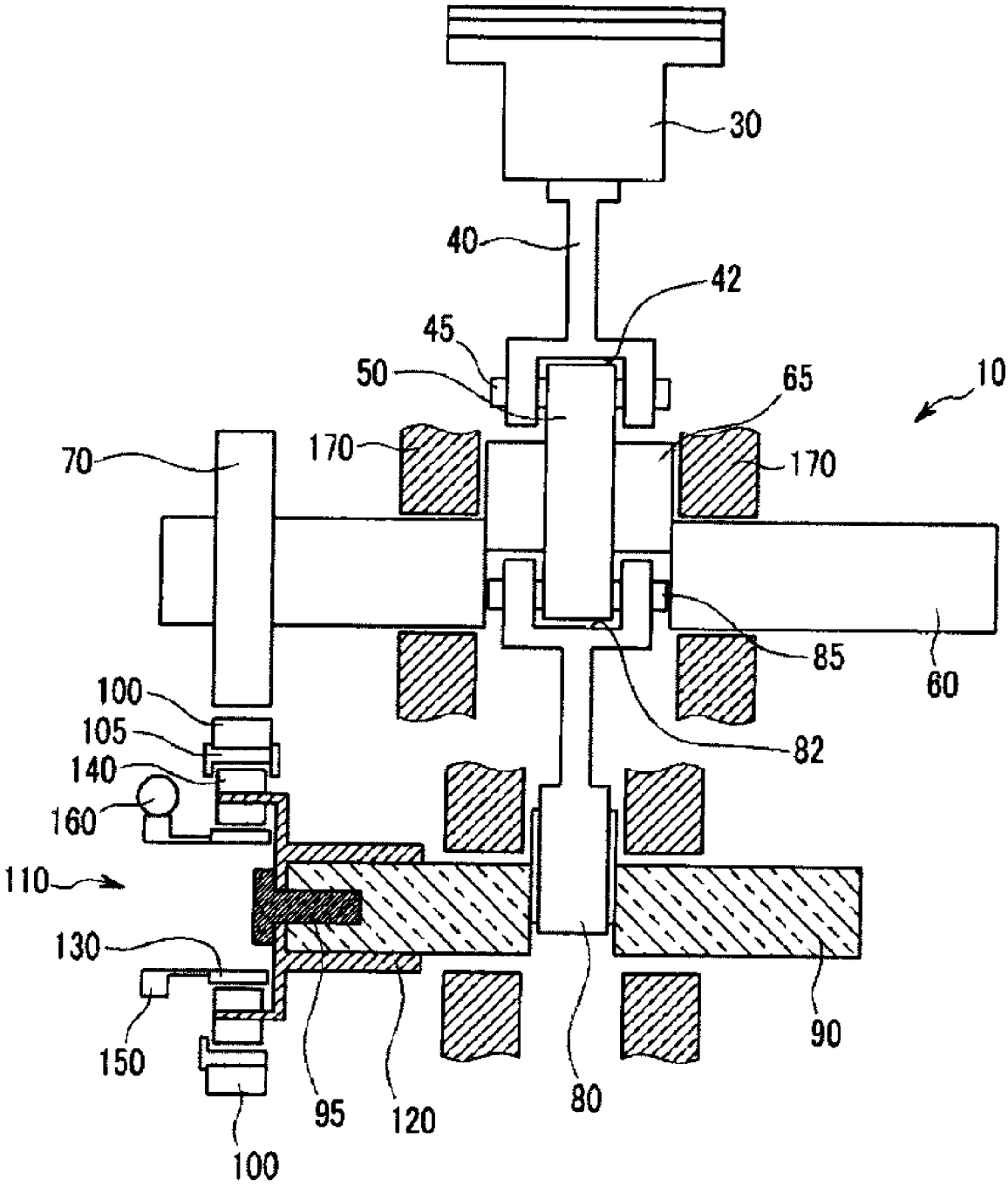
FIG. 2 is a cross-sectional view of an exemplary variable compression ratio apparatus according to the present invention.

As shown in FIG. 1 and FIG. 2, a variable compression ratio apparatus 10 according to an exemplary embodiment of the present invention is mounted to an engine that receives combustion force of an air-fuel mixture from a piston 30 and drives a vehicle, and changes the compression ratio of the air-fuel mixture.

The piston 30 moves up and down in a cylinder 20, and a combustion chamber is defined between the piston 30 and the cylinder 20. In addition, an intake valve for taking in the air-fuel mixture and an exhaust valve for exhausting the air-fuel mixture that is burned are mounted at the top of the cylinder 20 in an otherwise conventional manner. When the air-fuel mixture is burned in the combustion chamber, the combustion force is transmitted to the piston 30 and drives the vehicle.

The variable compression ratio apparatus 10 includes an upper connecting rod 40, a lower connecting rod 50, a crankshaft 65, a control rod 80, a control shaft 90, and a planetary gear set 110.

The upper connecting rod 40 transmits the combustion force from the piston 30 to the lower connecting rod 50. One end of the upper connecting rod 40 is rotatably connected to the piston 30 by a first joint member 35, such as a pin and a shaft. A first receiving groove 42 at the lower end of the upper connecting rod 40 forms a yoke that operably joins the upper connecting rod 40 with the lower connecting rod 50. A pin and a shaft that rotatably connects the two members can be used for the first joint member 35

The lower connecting rod 50 receives the combustion force from the upper connecting rod 40 and rotates the crankshaft 65. One end of the lower connecting rod 50 is disposed in the first receiving groove 42 of the upper connecting rod 40 and is rotatably connected to the upper connecting rod 40 by a second joint member 45. A pin and a shaft that rotatably connect two members can be used for the second joint member 45

In the illustrated exemplary embodiment, the lower connecting rod 50 is fan-shaped, i.e. thin and flat, and somewhat oval-shaped and having a generally arcuate side, but the claimed invention should not be construed as being limited thereto. One will appreciate that other geometric shapes and configurations may also be utilized in accordance with the present invention. In the illustrated embodiment, both ends of the lower connecting rod 50 are disposed on both ends of a fan-shaped arc.

The crankshaft 65 is rotatably mounted at the lower connecting rod 50 by a crank pin 85. Since the crankshaft 65 is eccentrically mounted at the lower connecting rod 50, the lower connecting rod 50 rotates a crank arm about the crankshaft 65 when the lower connecting rod 50 rotates. Therefore, the crankshaft 65 receives the combustion force from the piston 30, converts the combustion force into torque, and transmits the torque to a transmission. In addition, a crank gear 70 is coaxially and fixedly mounted to the crankshaft 65. A bearing 170 may be interposed between the crankshaft 65 and the engine so as to reduce frictional force.

The control rod 80 includes two ends and changes the compression ratio of the air-fuel mixture by changing a rotation trace or path of the lower connecting rod 50. A second receiving groove 82 is formed at one end of the control rod 80 to form a yoke with the lower connecting rod 50 disposed therein, and the other end of the lower connecting rod 50 is inserted in the second receiving groove 82. The other end of the lower connecting rod 50 is rotatably connected to the control rod 80 by a third joint member 85. A pin and a shaft that rotatably connects two members can be used for the third joint member 85.

The control shaft 90 is eccentrically and rotatably connected to the control rod 80. Therefore, a position of the other end of the control rod 80 is changed when the control shaft 90 rotates. An additional bearing 170 may be interposed between the control shaft 90 and the engine so as to reduce frictional force.

The planetary gear set 110 is a simple planetary gear set that has a sun gear 130, a planet carrier 120, and a ring gear 105 as operating members thereof. A plurality of pinion gears 140 engaging with the sun gear 130 and the ring gear 105 are connected to the planet carrier 120, and the planet carrier 120 is rotated by the pinion gears 140. In addition, one operating member 150 of the planetary gear set 110 is connected to a driving unit 165 and receives power therefrom.

Figure 4:
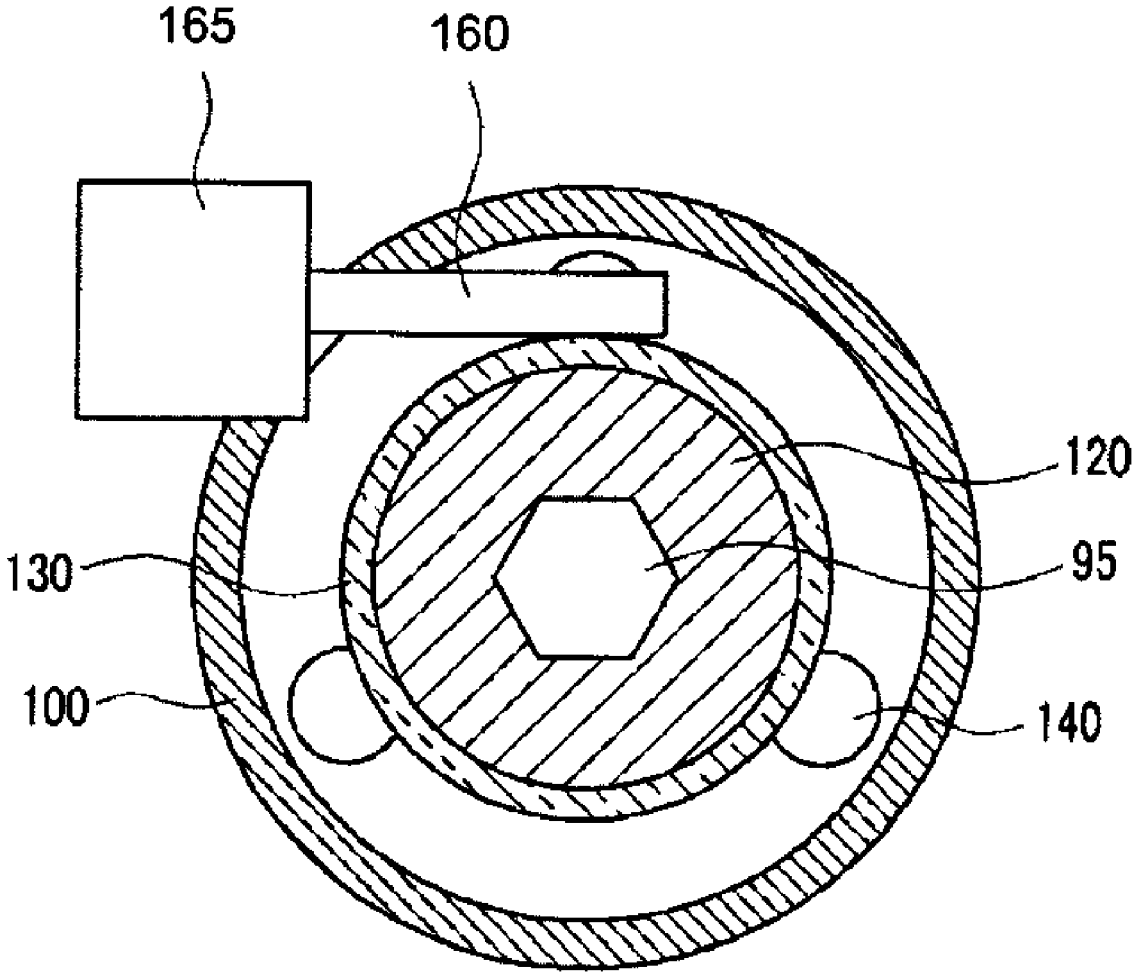
FIG. 4 is a side view showing combining structures of an exemplary planetary gear set and driving unit used in a variable compression ratio apparatus according to the present invention.

The driving unit 165 is provided with a drive shaft 160, which includes a power delivery unit such as, for example, a worm gear at its exterior surface. As shown in FIG. 4, the worm gear is engaged with the sun gear 130 so as to transmit power (i.e., rotation) of the driving unit 165 to the sun gear 130. One will appreciate that other suitable means may be used to rotate the sun gear as desired. The driving unit 165 may be a DC motor, a step motor, or other suitable means for transmitting the power to the drive shaft 160. The driving unit 165 is electrically coupled to an engine control unit in an otherwise conventional manner, and operates according to a signal of the engine control unit.

A control gear 100 is fixed to the ring gear 105, and the control gear 100 engages with the crank gear 70 of the crankshaft 65. Therefore, rotation of the crankshaft 65 is input to the ring gear 105 through the control gear 100. Alternatively, the ring gear 105 itself acts as the control gear, and may have gear teeth at an exterior surface.

Figure 3:
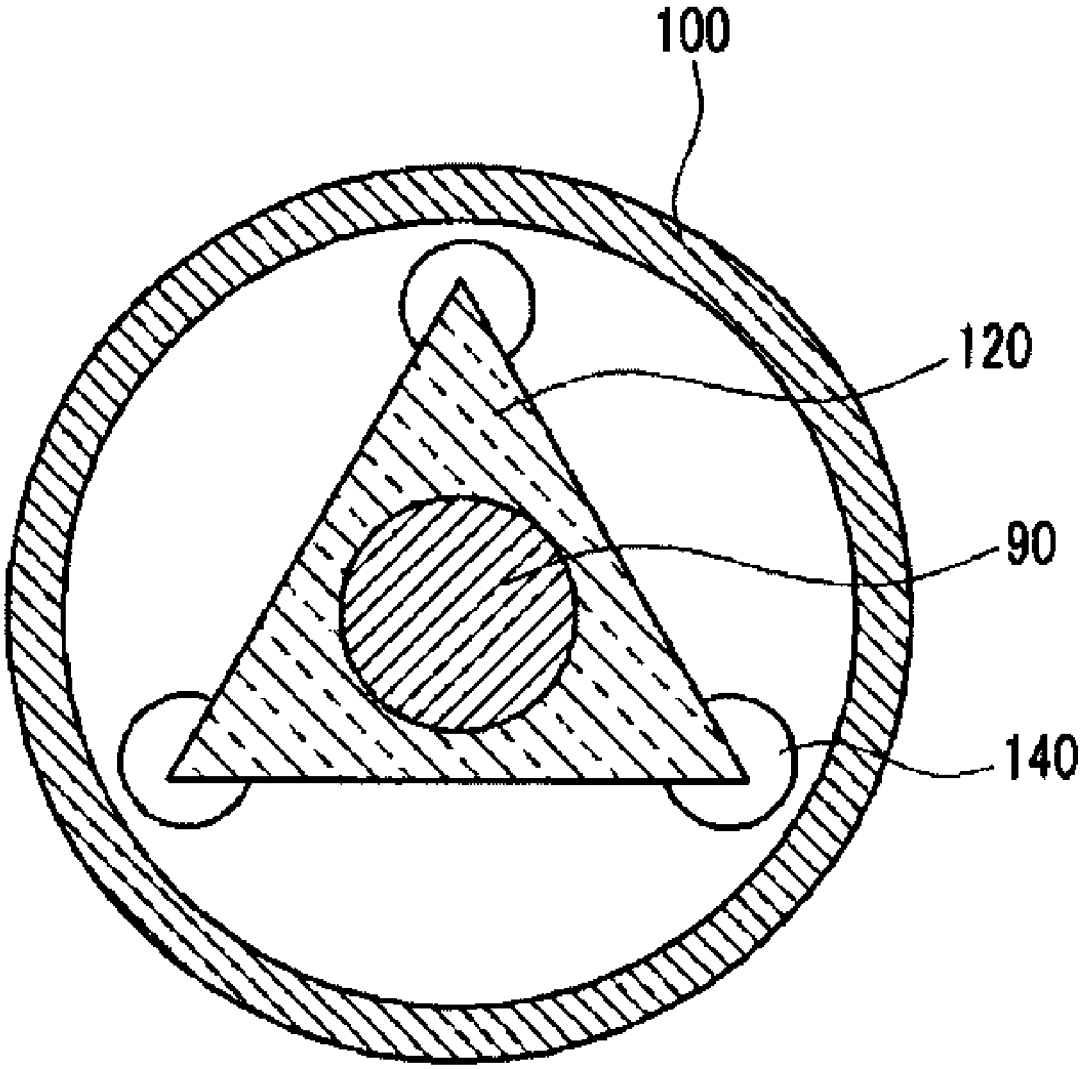
FIG. 3 is a side view showing combining structures of an exemplary planetary gear set and control shaft used in a variable compression ratio apparatus according to the present invention.

As shown in FIG. 3, the planet carrier 120 is coaxially combined to the control shaft 90 and rotates the control shaft 90. Rotation speed of the planet carrier 120 is determined by rotation speeds of the sun gear 130 and the ring gear 105 according to characteristics of the planetary gear set 110. Therefore, rotation speed of the control shaft 90 is determined by rotation speed of the crankshaft 60 and rotation speed of the drive shaft 160, and accordingly rotation speed of the crankshaft 60 can be different from rotation speed of the control shaft 90. Therefore, there is a phase difference between the crankshaft 60 and the control shaft 90 and the position of the top end of the control rod 80 changes according to phase of the crankshaft 60. Therefore, the rotation trace of the lower connecting rod 50 and accordingly the compression ratio of the air-fuel mixture are also changed.

The ratio of rotation speeds of the crankshaft 60 and the control shaft 90 can be selected as any appropriate ratio, such as 1:1 or 1:2. The engine control unit controls the driving unit 165 based on driving conditions such that the rotation speed ratio is the desired value.

Figure 5:
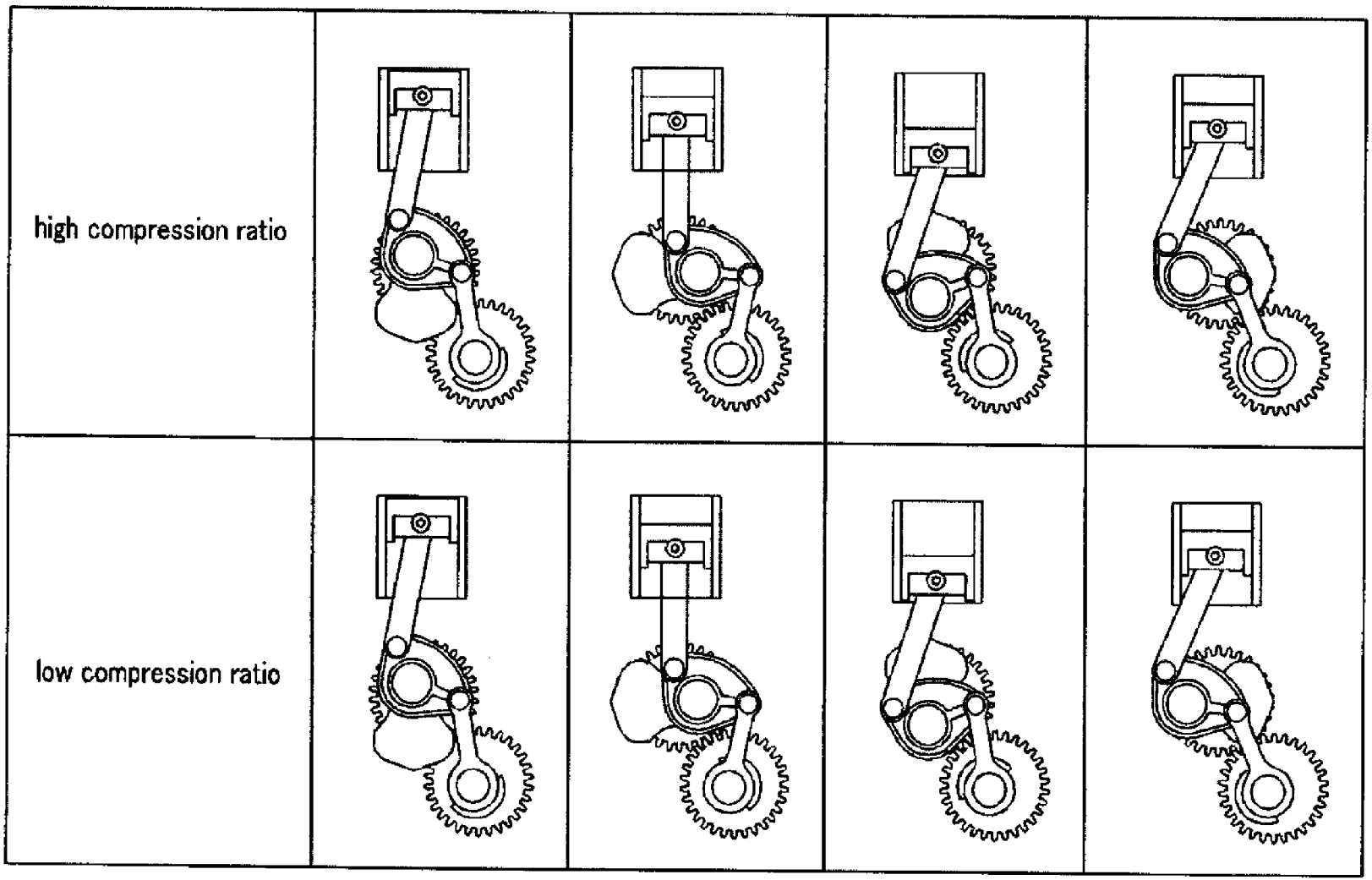
FIG. 5 is a schematic diagram showing operation of an exemplary variable compression ratio apparatus according to the present invention.

As shown in FIG. 5, comparing a case where the variable compression ratio apparatus operates in a high compression ratio with a case where the variable compression ratio apparatus operates in a low compression ratio, top dead center (TDC) of the piston 30 is heightened and bottom dead center (BDC) of the piston 30 is lowered.

Figure 6:
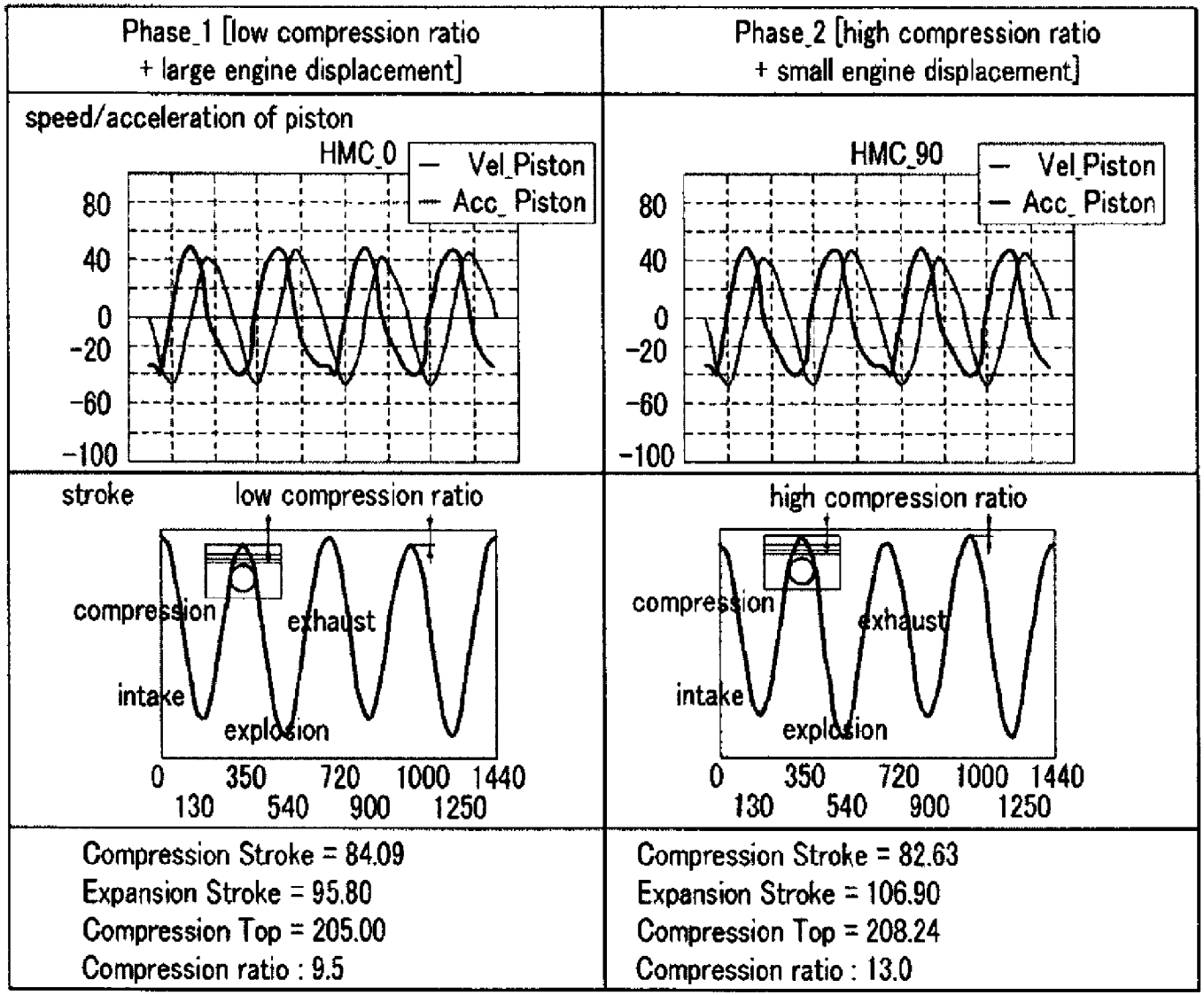
FIG. 6 is a graph showing speed and acceleration of a piston and stroke in an exemplary engine using a variable compression ratio apparatus according to the present invention.

When the variable compression ratio apparatus according to various embodiments of the present invention is used, the compression stroke may be varied from the expansion stroke by controlling the rotation speed ratio of the crankshaft 60 to the control shaft 90. Such examples are shown in FIG. 6. As shown in FIG. 6, when the variable compression ratio apparatus according to various embodiments of the present invention is operated at a low compression ratio, the compression stroke is 84.09 mm and the expansion stroke is 95.8 mm. In addition, when the variable compression ratio apparatus according to various embodiments of the present invention is operated at a high compression ratio, the compression stroke is 82.63 mm and the expansion stroke is 106.9 mm. Therefore, thermal efficiency and fuel mileage may be enhanced since the stroke of the expansion stroke is longer than that of the compression stroke.

Here, only the compression and expansion strokes have been discussed, but one will appreciate that any of the intake, compression, expansion, or exhaust strokes can be varied by controlling the rotation speed ratio of the crankshaft 60 to the control shaft 90.

One will also appreciate that the specific numerical values described as above can of course be selected based on target engine performance.

According to a variable compression ratio apparatus of the present invention, fuel mileage may be enhanced at a low-load driving state and output may be enhanced at a high-load driving state since the compression ratio of the air-fuel mixture continuously changes while an engine operates.

In addition, a variable compression ratio may be achieved by a rotation speed ratio of the crankshaft to the control shaft of 1:1, and an Atkinson cycle as well as a variable compression ratio may be achieved by a rotation speed ratio of the crankshaft to the control shaft of 1:2.

For convenience in explanation and accurate definition in the appended claims, the terms "upper" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus for an engine receiving a combustion force of an air-fuel mixture within a piston chamber so as to drive a vehicle, wherein the apparatus is configured to change compression ratio of the air-fuel mixture within the piston chamber, the apparatus comprising:

an upper connecting rod having one end rotatably connected to the piston so as to receive combustion force of the air-fuel mixture;

a lower connecting rod having one end rotatably connected to a second end of the upper connecting rod and rotated by the combustion force of the air-fuel mixture received from the upper connecting rod;

a crankshaft eccentrically mounted to the lower connecting rod so as to be rotated thereby;

a control rod provided with one end rotatably connected to a second end of the lower connecting rod so as to change the path of motion of the lower connecting rod;

a control shaft eccentrically and rotatably connected to a second end of the control rod and changing a position of the other end of the control rod; and a planetary gear set that receives torque from a driving unit and changes phase angles of the crankshaft and the control shaft.

2. The variable compression ratio apparatus of claim 1, wherein the planetary gear set comprises:

a first operating member connected to the control shaft and rotating with the control rod;

a second operating member connected to the crankshaft and rotating the crankshaft; and a third operating member connected to the driving unit and receiving the torque for changing the phase angle of the control shaft.

3. The variable compression ratio apparatus of claim 2, wherein a crank gear is fixedly mounted at the crankshaft, and a control gear engaged with the crank gear is fixedly mounted at the second operating member.

4. The variable compression ratio apparatus of claim 2, wherein the driving unit comprises a drive shaft, and wherein a power delivery unit for being connected to and transmitting the torque to the third operating member is mounted at the drive shaft.

5. The variable compression ratio apparatus of claim 2, wherein the driving unit is configured such that a ratio of rotation speed of the crankshaft to that of the control shaft is approximately 1:1 or 1:2.

6. The variable compression ratio apparatus of claim 2, wherein the planetary gear set has a sun gear, a ring gear, and a planet carrier, and wherein the first operating member is the planet carrier, the second operating member is the ring gear, and the third operating member is the sun gear.

7. The variable compression ratio apparatus of claim 1, wherein the lower connecting rod has a fan shape, and both ends of the lower connecting rod are disposed on both ends of a fan-shaped arc.

8. A variable compression ratio apparatus, comprising:

an upper connecting rod including a first and a second end, the first end being rotatably connected to a piston so as to reciprocate the piston;

a lower connecting rod including a first and a second end, the first end being rotatably connected to the second end of the upper connecting rod;

a crankshaft rotatably mounted at an eccentric position of the lower connecting rod;

a control rod including a first and a second end, the first end being rotatably connected to the second end of the lower connecting rod so as to control a position of the second end of the lower connecting rod;

a control shaft connected to the second end of the control rod so as to control a position of the second end of the control rod; and a planetary gear set configured to control phase angles of the crankshaft and the control shaft.

9. The variable compression ratio apparatus of claim 8, wherein the planetary gear set comprises:

a first operating member connected to the control shaft for rotating with the control rod;

a second operating member connected to the crankshaft for rotating the crankshaft; and a third operating member connected to the driving unit for controlling the phase angle of the control shaft.

10. The variable compression ratio apparatus of claim 9, further comprising a crank gear mounted to the crankshaft, and a control gear mounted to the second operating member and engaged with the crank gear.

11. The variable compression ratio apparatus of claim 9, wherein the driving unit comprises a drive shaft, and the apparatus further includes a power delivery unit mounted at the drive shaft for operating the third operating member.

12. The variable compression ratio apparatus of claim 9, wherein the driving unit is configured such that a ratio of a rotation speed of the crankshaft to a rotation speed of the control shaft is approximately 1:1 or 1:2.

13. The variable compression ratio apparatus of claim 9, wherein the first operating member is a planet carrier, the second operating member is a ring gear, and the third operating member is a sun gear.

14. The variable compression ratio apparatus of claim 8, wherein the lower connecting rod comprises an oblong shape.

* * * * *